United States Patent [19]

Shatto

[11] Patent Number: 4,721,415

[45] Date of Patent: Jan. 26, 1988

[54] WELL BASE IN OCEAN FLOOR

[75] Inventor: Howard L. Shatto, Houston, Tex.

[73] Assignee: Shell Offshore Inc., Houston, Tex.

[21] Appl. No.: 871,338

[22] Filed: Jun. 6, 1986

[51] Int. Cl.[4] ..... E02D 7/00; E02D 29/00; E21B 33/043

[52] U.S. Cl. ..... 405/226; 405/195; 405/224; 114/296; 166/368

[58] Field of Search ..... 405/8, 195, 224, 226, 405/227, 228, 248, 172; 166/335, 350, 356, 366, 368; 114/296; 417/172

[56] References Cited

U.S. PATENT DOCUMENTS

| | | | |
|---|---|---|---|
| 3,263,641 | 8/1966 | Stimson | 114/296 |
| 4,257,721 | 3/1981 | Haynes | 114/296 X |
| 4,318,641 | 3/1982 | Hogervorst | 405/224 |
| 4,432,671 | 2/1984 | Westra et al. | 114/296 X |
| 4,588,744 | 12/1985 | Gibb | 166/356 X |
| 4,591,295 | 5/1986 | Collipp | 405/224 X |

FOREIGN PATENT DOCUMENTS 299649 9/1954 Switzerland .

*Primary Examiner*—Nancy J. Stodola

[57] ABSTRACT

A wellhead apparatus and a method for positioning the apparatus on the ocean floor. The wellhead apparatus is equipped with a removable pump and a central opening for receiving a well conductor pipe. The apparatus provides a well base structure that is highly stable, capable of taking high vertical and lateral loads, and can be controlled during installation to be either truly plumb or positioned at a predetermined angle relative to the vertical.

9 Claims, 2 Drawing Figures

WELL BASE IN OCEAN FLOOR

RELATED APPLICATIONS

This application is related to Applicant's co-pending application Ser. No. 868,864 filed on May 30, 1986.

FIELD OF THE INVENTION

This invention relates to an ocean-floor wellhead apparatus for use in drilling offshore oil and gas wells in combination with means for sinking it into the ocean floor and drilling a well therethrough.

BACKGROUND OF THE INVENTION

Deepwater wellheads of oil and gas wells are generally put in place by lowering a drill string having a bit at the bottom, boring a hole in the ocean floor, and lowering a wellhead apparatus down the drill string. A large-diameter length of pipe is generally secured to the bottom of the wellhead, lowered into the drilled hole and centered therein.

Housing for wellhead equipment may consist of subsea caisson having an open bottom that is lowered to the ocean floor and a pressure displacement dredging system to remove the soil inside the caisson. Such a device is set forth in U.S. Pat. No. 4,558,744 issued on Dec. 17, 1985. However, in this patent an apparatus in the caisson is used to remove the soil against its inner walls which eliminates soil friction inside the caisson which is positioned below the ocean floor.

It is also recognized that ship anchors have been positioned in the ocean floor by sucking them into the ocean floor in accordance with the method and apparatus disclosed in U.S. Pat. No. 4,432,671 issued on Feb. 21, 1984. However, the apparatus of this invention requires the use of a specially designed underwater motor-driven pump together with power-transmission cables, which are removably connected to the anchor prior to installing the anchor in the ocean floor, and subsequently remotely disconnected from the anchor for removal to the ocean surface.

It is an object of the present invention to provide a well base structure that is highly stable, capable of taking high vertical and lateral loads, and can be controlled during installation to be either truly plumb or positioned at a predetermined angle relative to the vertical. Another object of the present invention is to provide an underwater wellhead apparatus that can be transported to the drilling location on a relatively small vessel and lowered to the ocean floor. The apparatus, upon being positioned on the ocean floor, is subsequently sucked into the ocean floor by means of suction created by a removable pump carried by the wellhead apparatus. The apparatus is anchored in the ocean floor by frictional resistance against both the internal and external walls of the apparatus. The apparatus is further provided with means whereby a well may be drilled through it and into the ocean floor.

Applicant is not aware of any prior art, which, in his judgment as one skilled in this particular art would anticipate or render obvious the present invention. However, for the purpose of fully developing the background of the invention, and establishing the state of requisite art, the following art is set forth: U.S. Pat. Nos. 4,558,744; 4,576,518; 3,263,641; 4,575,282; 1,031,289; 1,227,180; 2,080,623; and Swiss Pat. No. 299,649.

SUMMARY OF THE INVENTION

This invention relates to a wellhead apparatus and a method for positioning the apparatus on the ocean floor in combination with means for sinking it into the ocean floor. The wellhead apparatus is equipped with a removable pump and a central opening for receiving a well conductor.

A removable pump is positioned on an open-bottom container assembly or arrangement of containers so that the pump may be placed in fluid communication with ports through the upper end of the container assembly.

Once the wellhead apparatus is lowered to the ocean floor, the angle of the wellhead apparatus relative to the vertical is determined. This may be done in any well-known suitable manner, as by a camera carried by an underwater remotely-operated vehicle (ROV) or a level-indicating device positioned on the wellhead apparatus. It may be desirable in some locations to position the wellhead apparatus at an angle, say 10 to 20 degrees, with respect to the vertical, such as in the case where the wellhead apparatus is to be positioned on the ocean floor so as to drill a well beneath a shipping lane in which a drilling vessel may not be positioned. If a level-indicating device is employed, it may be connected to a controller located on the apparatus or aboard a vessel from which, in turn, a signal can be transmitted to actuate valves carried by the container assembly for adjusting the wellhead apparatus to a predetermined angle relative to the vertical.

The removable pump positioned on the wellhead apparatus creates suction within the container assembly. The suction is terminated by shutting off the pump when the container assembly has penetrated the ocean floor to a selected depth.

The pump is then disconnected from the container assembly and raised by a cable to the water surface.

A well conductor is then lowered from the surface vessel through the central opening of the wellhead apparatus to be seated on landing surfaces formed of a supporting device positioned central to the container assembly which have a downwardly- directed opening therethrough.

An advantage of the present invention is that a solidly anchored wellhead apparatus may be positioned on the ocean floor to serve as a base for subsea drilling and/or production facilities such as a drilling wellhead assembly which may include connectors, blow out preventers, etc. of a type well known to the art and used in drilling underwater wells.

Another advantage of the present invention is that it is not necessary to drill a hole in the ocean floor prior to installing the underwater wellhead or the platform on which the underwater wellhead is securely positioned during the drilling of a well.

A further advantage of the present invention is that it permits the drilling of a well into the ocean floor at a predetermined angle, say two to twenty degrees from the vertical. The present method and apparatus provides means for positioning an offshore wellhead at a selected angle relative to the vertical.

The various features of novelty which characterize the invention are pointed out with particularity in the claims forming a part of this disclosure. For a better understanding of the invention, its operating advantages and specific objects obtained by its uses, references should be made to the accompanying drawings and descriptive matter in which there are illustrated preferred embodiments of the invention.

A BRIEF DESCRIPTION OF THE DRAWINGS

FIG. 1 is a schematic view of a level-indicating device, controller, and remotely-actuated valves on the wellhead apparatus; and FIG. 2 is a plan view of another embodiment of a wellhead apparatus having a base plate for supporting well equipment.

DESCRIPTION OF THE PREFERRED EMBODIMENT

Figure 1:
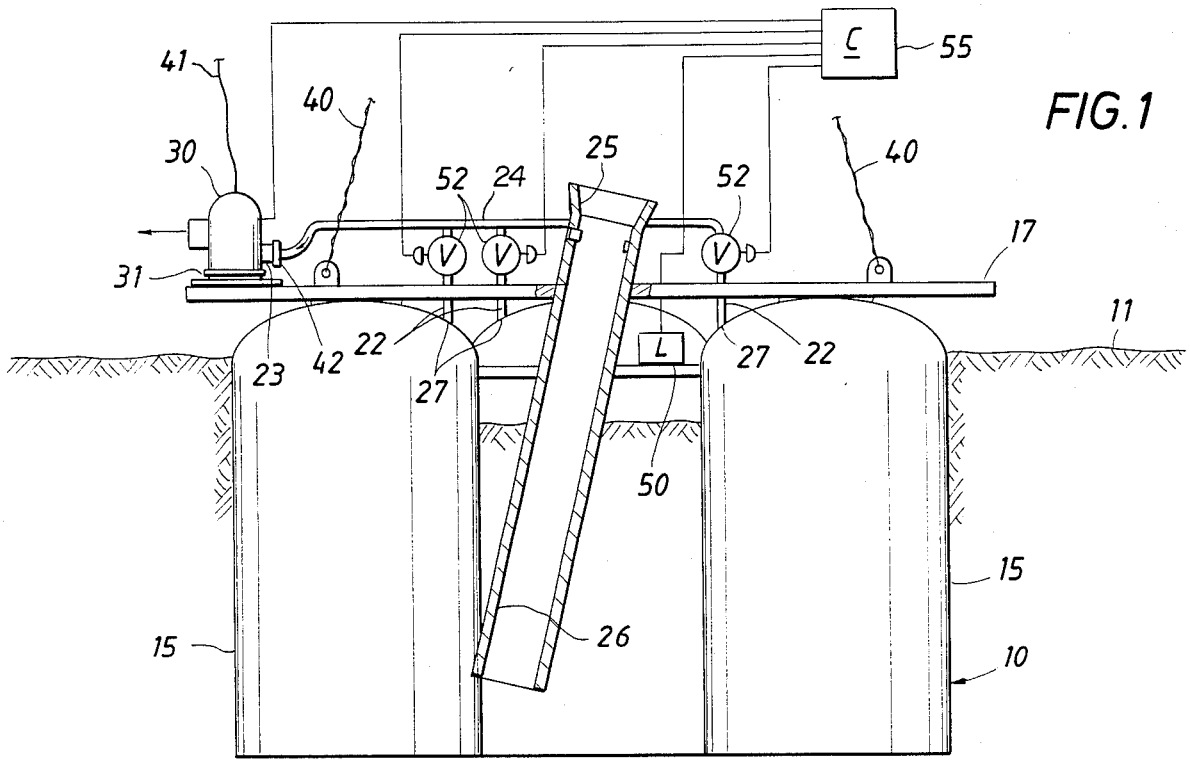

Referring to FIG. 1 of the drawing, a wellhead apparatus represented herein by numeral 10, may comprise a plurality of open-bottomed containers 15 adapted to be sunk into the ocean floor 11 such that the tops of the containers are above the ocean floor 11 to form a base for well equipment. The container edges, when penetrating the ocean floor 11, provide a seal limiting the entry of water into the containers 15.

A removable pump 30 is engageable and disengageable with the wellhead apparatus 10 by means of a remotely actuatable connector 31 of any suitable type well known to the art. The wellhead apparatus 10 is secured to and lowered by a weight supporting lowering device, such as a cable 40, extending from the ocean floor 11 to a point above the water surface. A power transmission cable 41, is operatively engageable with the removable pump 30 and is lowerable with the pump 30.

The container 15 shown in FIG. 1 is provided with a landing surface 25 to engage a well conductor (not shown). A sleeve 26 of the container 15 is centrally positioned in the wellhead apparatus 10 and extends downwardly from the landing surface 25 of the container 15.

A suitable cooperating connector 42 connects the removable pump 30 to a manifold or concuit 24 in a fluid-communication manner.

Fluid conduits 22 are in communication with the interior of the containers 15 and the conduit 24. The fluid conduit 22 include at least one port 27 through the wall of each of the containers 15 near its upper end.

Figure 2:
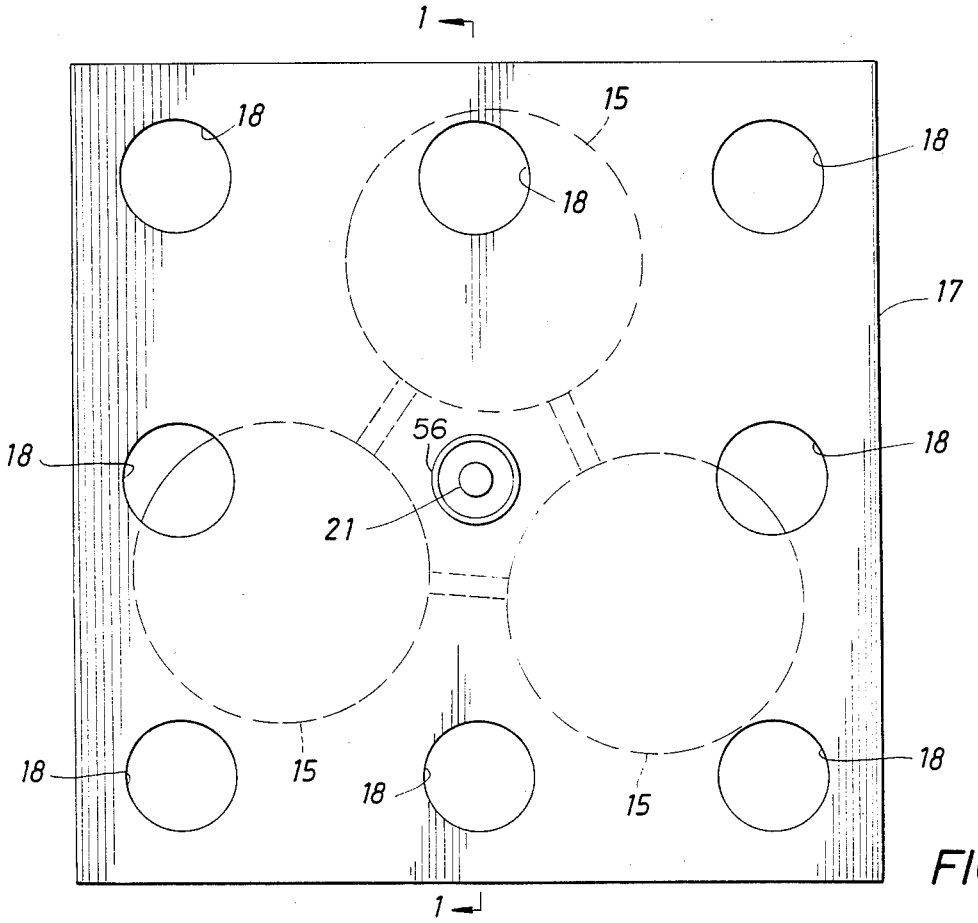

A base 17, as shown in FIG. 2, may be connected to the tops of a plurality of containers 15 to provide a surface for supporting equipment associated with the use of the wellhead apparatus 10. Holes 18 may be provided in the base 17 to permit the base 17 to be more easily lowered from a vessel on the water surface (not shown) to the ocean floor 11. The plurality of containers 15 shown in FIG. 2 are positioned in the ocean floor 11 in close fixed proximity to each other. A supporting device 56 for receiving the well conductor is positioned central to the containers 15 and has a downwardly directed opening 21 therethrough for receiving a well conductor.

Referring to FIG. 1, the wellhead apparatus 10 may include and have mounted thereon a level-indicator 50 to determine the angle of the containers 15 relative to the vertical. A level-controlling system may include a level-indicator 50, valves 52 connected in communication with the ports 27 of the containers 15 for selectively evacuating water from selected containers 15. The controller 55 located on the apparatus 10 or on board a vessel at the water surface is in communication with the level-indicator 50 and the valves 52 to selectively open the valves 52 based on the desired angle that the containers 15 are to be positioned relative to the vertical.

The method for positioning the wellhead apparatus 10 and sinking it into the ocean floor 11, comprises the initial step of connecting the removable pump 30 to the wellhead apparatus 10 in a manner such the removable pump 30 is in fluid communication with the containers 15. That is, the removable pump 30 is seated and aligned with the containers 15 so that the suction port 23 of the removable pump 30 communicates with the ports 27 of the containers 15. This step is done prior to lowering the wellhead apparatus 10 to the ocean floor 11.

The wellhead apparatus 10 is then lowered to the ocean floor 11 by a cable 40 or any other suitable means extending to a surface vessel (not shown).

Next, it is determined whether the containers 15 are at the desired angle relative to the vertical. This may be done in any manner well known to the art such as a camera carried by an underwater remotely-operated vehicle (ROV) or a level-indicator 50. A signal is transmitted from the level indicator 50 to a controller 55 to indicate the angle of the containers 15 relative to the vertical. The position indicated by the controller 55 is compared with a selected predetermined angle of the containers 15 relative to the vertical. If angular adjustment of the containers 15 is necessary, a signal is transmitted from the controller 55 or in any other suitable manner to actuate the valves 52 carried by the containers 15 selectively according to the desired angle of the containers 15 relative to the vertical. Alternatively, the valves 52 may be actuated manually if the controller 55 is not utilized.

To sink the containers 15 into the ocean floor 11 to a selected depth (FIG. 1), the pump 30 is operated with one or more of the valves 52 in an open position to evacuate the containers 15 simultaneously or selectively to achieve the desired penetration and angle of the wellhead apparatus 10 in the ocean floor 11. The wellhead apparatus 10 is anchored in the ocean floor 11 by frictional resistance against both the internal and external walls of the containers 15. When the containers 15 have sunk into the ocean floor to a selected depth and are located at the desired angle, the suction within the containers 15 is terminated by shutting off the pump 30. The removable pump 30 is then disconnected from the base 17 of the wellhead apparatus 10. The removable pump 30 and power transmitting cable 41 are raised to the water surface by the cable 40.

A well conductor (not shown) is then lowered from the surface vessel through the central opening of the wellhead apparatus 10 to be seated on the landing surfaces 25 of the containers 15 having a downwardly-directed opening therethrough.

Alternatively, the apparatus 10 may be positioned on the ocean floor 11 in accordance with the present invention to serve as a base for subsea drilling and production facilities such as a template (not shown) for drilling a multiplicity of wells, or as an ocean-floor base for oil and/or gas manifold systems, production or separator equipment, underwater storage facilities, pipelines, underwater mining facilities, etc.

Thus, it can be seen that the above-mentioned objective may be accomplished, based on the description of the preferred embodiment, by practicing the above-mentioned method.

What is claimed is:

1. A method of positioning a wellhead apparatus at a selected angle in the ocean floor, the method comprising:

providing a plurality of open-bottomed containers having an open-end well conductor guide to receive a downwardly-directed well conductor and form an underwater wellhead through which a well may be drilled and produced;

providing ports near the top and through the wall of each of said containers for evacuating water therefrom;

providing a pump removably engageable with said wellhead apparatus, said pump having a suction port in fluid communication with the containers of said wellhead apparatus;

providing a power transmitting cable operatively engageable with said pump and lowerable therewith to acitvate said pump;

providing valves connected to the ports of each of said containers for selectively controlling water flow therefrom;

positioning said pump so that the suction port of said pump communicates with each of said containers;

lowering said wellhead apparatus until it is on the ocean floor with the top of said apparatus being above the ocean floor to form a base for well equipment;

determining the level of each of said containers relative to the vertical;

actuating said pump using the power transmitting cable to create suction within each of said containers;

actuating said valves selectively to achieve a desired level of each of said containers relative to the vertical;

terminating suction within each of said containers when each of said containers has sunk into the ocean floor to a selected depth and at the selected angle;

disconnecting said pump from said wellhead apparatus; and raising said pump and power transmitting cable to the ocean surface.

2. The method of claim 1 wherein the step of actuating said valves includes the steps of:

providing a level-indicator in communication with each of said containers to determine the position of each of said containers relative to the vertical;

providing a controller in communication with said level-indicator and said valves to open or close said valves;

transmitting a signal from said level-indicator to said controller to indicate the angle of each of said containers relative to the vertical; and comparing the position indicated by the controller with a selected predetermined angle of each of said containers relative to the vertical.

3. The method of claim 2 including the step of transmitting a signal from said controller prior to actuating said valves selectively according to the desired angle of each of said containers relative to the vertical.

4. A wellhead apparatus adapted to be positioned on the ocean floor, said apparatus comprising:

a plurality of containers adapted to be positioned in the ocean floor in close fixed proximity to each other, each of said containers having a port through the wall thereof near the upper end thereof;

a removable pump operatively engageable and disengageable with said wellhead apparatus, said pump having a suction port in fluid-flow communication with each of said ports of each of said containers for evacuating water from each of said containers and applying a vacuum thereto;

a plurality of fluid conduits in communication between the interior of each of said containers and said suction port of said pump;

valves in operative communication with said ports of each of said containers for selectively controlling water from from each of said containers in response to the angle of each of said containers relative to the vertical during normal operations;

a supporting device positioned central to each of said containers, said supporting device having a downwardly-directed opening therethrough for receiving a well conductor therein;

a landing surface formed adjacent said opening and carried by said supporting device, said landing surface being adapted to engage a well conductor positioned in said opening;

a cooperating connector carried by said pump and said wellhead apparatus for connecting said wellhead aparatus to said pump in a weight-supporting and fluid-communicationg manner;

means for lowering said wellhead apparatus from a point above the water surface to the ocean floor, said means being adapted to be secured to the wellhead apparatus; and a power transmitting cable operatively engageable with said pump and lowerable therewith to activate said pump.

5. The apparatus of claim 4 including a sleeve centrally positioned in said wellhead apparatus and extending downwardly from said supporting device.

6. The apparatus of claim 4 wherein each of said containers' edges when penetrating the ocean floor provide a seal limiting the entry of water into each of said containers.

7. The apparatus of claim 4 wherein said wellhead apparatus includes a level-indicator in communication with each of said containers to determine the position of each of said containers relative to the vertical.

8. The apparaus of claim 7 including a controller in communication with said level-indicator and said valves to selectively open said valves based on the desired angle of each of said containers relative to the vertical.

9. A subsea apparatus adapted to being positioned on the ocean floor, said apparatus comprising:

a plurality of containers adapted to be positioned in the ocean floor in close fixed proximity to each other, each of said containers having a port through the wall thereof near the upper end thereof;

a removable pump operatively engageable and disengageable with said subsea apparatus, said pump having a suction port in fluid-flow communication with each of said ports of each of said containers for evacuating water from each of said containers and applying a vacuum thereto;

a plurality of fluid conduits in communication between the interior of each of said containers and said suction port of said pump;

valves in operative communication with said ports of each of said containers for selectively controlling water flow from each of said containers in response to the angle of each of said containers relative to the vertical during normal operations;

a supporting device positioned central to each of said containers, said supporting device having a downwardly-directed opening therethrough for receiving a well conductor therein;

a landing surface formed adjacent said opening and carried by said supporting device, said landing surface being adapted to engage a well conductor positioned in said opening;

a cooperating connector carried by said pump and said subsea apparatus for connecting said subsea apparatus to said pump in a weight-supporting and fluid-communicating manner;

means for lowering said subsea apparatus from a point above the water surface to the ocean floor, said means being adapted to be secured to the subsea apparatus; and a power transmitting cable operatively engageable with said pump and lowerable therewith to activate the pump.

* * * * *